US005845778A

United States Patent [19]

Hickey, Jr.

[11] Patent Number: 5,845,778

[45] Date of Patent: Dec. 8, 1998

[54] HAT DISPLAY STRUCTURE

[76] Inventor: John Hickey, Jr., 2 Cameron St., West Haverstraw, N.Y. 10993

[21] Appl. No.: 993,404

[22] Filed: Dec. 18, 1997

[51] Int. Cl.[6] ..... B65D 85/18

[52] U.S. Cl. ..... 206/459.5; 206/8; 206/461

[58] Field of Search ..... 40/1, 124.06, 724; 206/8, 9, 232, 459.5, 461–463, 467, 469–471, 457

[56] References Cited

U.S. PATENT DOCUMENTS

| | | | |
|---|---|---|---|
| 3,420,361 | 1/1969 | Newberg | 206/471 |
| 4,453,629 | 6/1984 | Goldberg . | |
| 4,653,642 | 3/1987 | Hakun . | |
| 5,022,515 | 6/1991 | Agostine . | |
| 5,074,410 | 12/1991 | Fries | 206/8 |
| 5,209,354 | 5/1993 | Thornhill . | |
| 5,611,432 | 3/1997 | Dods | 206/459.5 |

*Primary Examiner*—Jim Foster
*Attorney, Agent, or Firm*—Stanley J. Yavner

[57] ABSTRACT

A hat display structure is shown to include an opaque substrate, a transparent layer connected to the substrate by snaps or the like at its edges, and a multi-piece frame, which, in turn, is snapped onto the layer. The transparent layer is formed to, in part, conform to the shape of an athletic hat or cap, with a bill, which has its crown folded in half, with the back half folded inwardly of the front half. Provision is also made in the layer for housing a plaque or the like in order designate or explain the significance of the hat or cap displayed.

4 Claims, 1 Drawing Sheet

HAT DISPLAY STRUCTURE

FIELD OF THE INVENTION

This invention relates to display structures, and more particularly to such display structures for sports memorabelia.

BACKGROUND OF THE INVENTION

During the last few decades, a large commercial industry has grown up in the United States, centered on the purchase, sale and display of memorabelia, particularly as to sports memorabelia. For instance, the purchase, sale and display of baseball cards has become a multi-million dollar industry. Also, the display of autographed baseballs is another example of this industry.

With respect to autographed baseballs, it is common to buy and sell such memorabelia with a pedestal and a transparent spherical display piece mounted on the pedestal, and into which the autographed baseball is housed, supported and preserved.

As part of the commercial transactions in the field relating to sports memorabelia, are basesball hats, with or without autographs; and/or to designate the baseball caps worn by certain professional players or teams, has become popular. Unfortunately, however, nothing exists on the market which satisfactorily displays, preserves and designates the significance of such baseball caps. For instance, U.S. Pat. No. 5,022,515, issued Jun. 11, 1991 to Agostine, relates to a hat storage container for a plurality of hats. However, the display objective of the present invention is not satisfied, especially with respect to the purpose of displaying a single hat, of particular significance, as distinguished from simply a bunch of hats.

Thornhill, et al, in U.S. Pat. No. 5,209,354, is also of interest in the respect that it presents a reusable blister package, but with respect to the objectives of the present invention, Thornhill presents more of a packaging and designating purpose, rather than addressing the purposes of display and preservation, important in the memorabelia field. Likewise, Goldberg, U.S. Pat. No. 4,453,629 presents a method for displaying masks, but without the structural features, as with the present invention, which lend themselves to display of memorabelia, such as baseball caps. Still further, the Hakun U.S. Pat. No. 4,653,642 is also a mask display structure, but again as a structure not particularly suited to the display and preservation of baseball caps or other memorabelia, with the capability for designating or explaining such memorabelia.

SUMMARY AND OBJECTS OF THE INVENTION

Accordingly, it is a primary object of the present invention to provide a display and to preserve an item of memorabelia in a sturdy and attractive manner.

A further object of the present invention is to provide a structure with the above capabilities, and which also displays and mounts a designation or explanation of the item of sports memorabelia.

These and other objects of the present invention are provided in a display structure, which includes an opaque substrate and a transparent layer overlaying the substrate, and connected thereto by snaps or the like at its edges. Both the substrate and the transparent layer are mounted and held together with a frame, by snaps or by other fasteners. The transparent layer is formed in a manner to conform to the item of memorabelia being displayed. In a preferred form of the invention, the transparent layer is expanded in a direction opposite to the underlying substrate to conform to the shape of an athletic hat or cap having a bill, and which has its crown folded in half, and with the back half folded inwardly of the front half of the crown. Another expansion is provided, proximate the cap expansion in the transparent layer, in order to house a plaque or the like to designate or explain the significance of the item of memorabelia displayed.

BRIEF DESCRIPTION OF THE DRAWINGS

Other objects, features and advantages of the present invention will be described by the following more detailed description of a preferred, but nonetheless illustrative, embodiment, with reference to the accompanying drawing, wherein.

DETAILED DESCRIPTION OF THE PREFERRED EMBODIMENT

Figure 2:
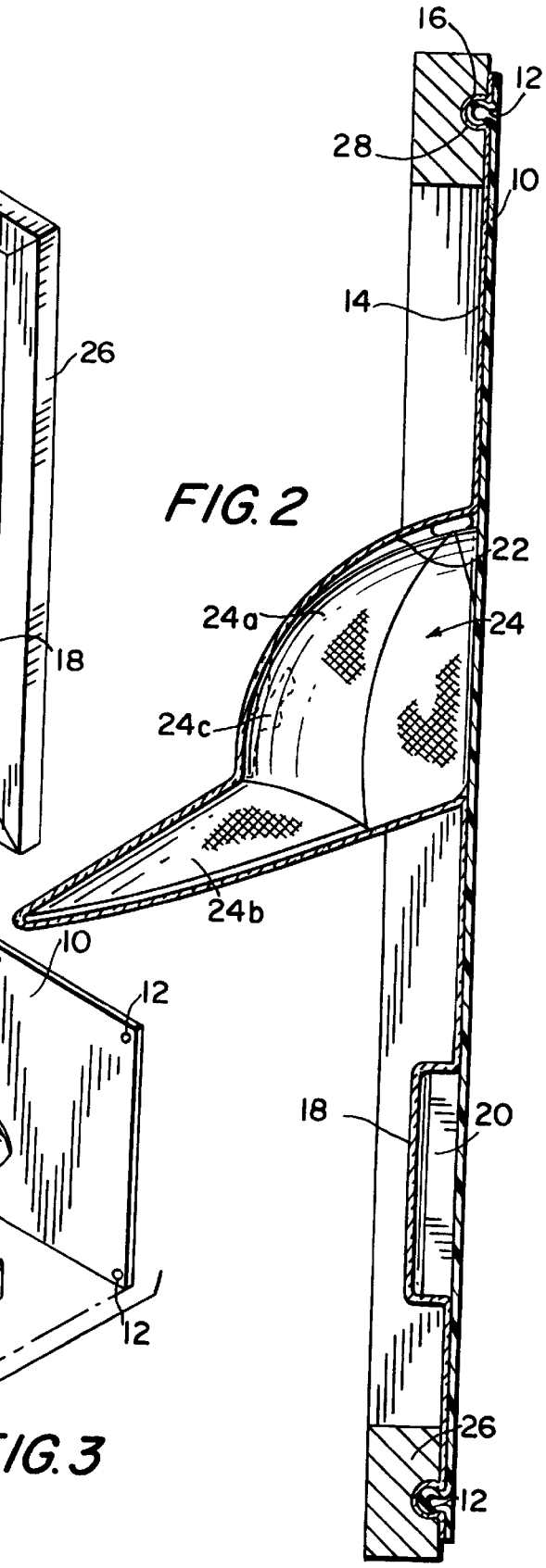
FIG. 2 is a right side, sectional view, taken along the line 2—2 of FIG. 1, and showing particularly the forward expansions of the transparent layer for mounting, displaying and preserving a baseball cap and for mounting a plaque designating the significance thereof.
Figure 3:
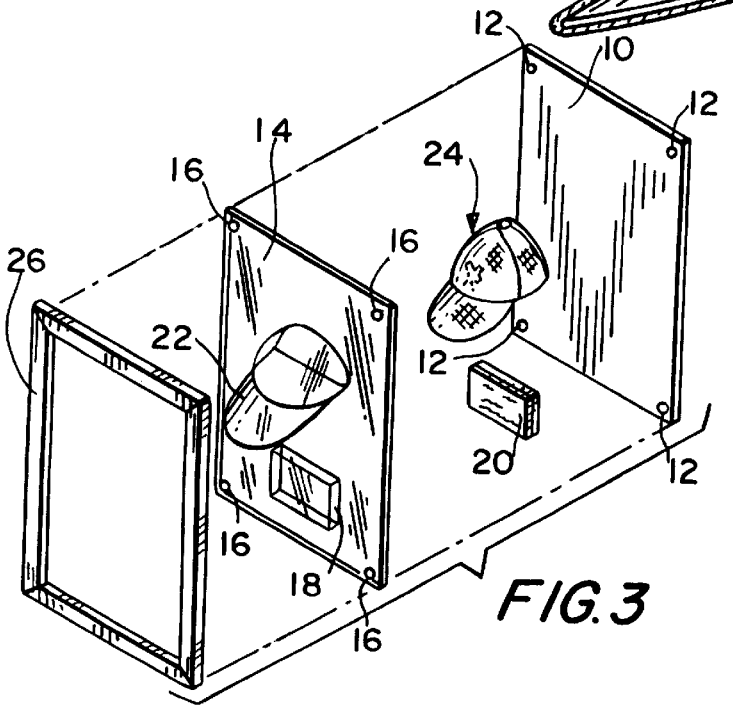
FIG. 3 is an exploded view showing the various elements of the structure of FIG. 1, as well as the displayed baseball cap and designating plaque.

Referring to the drawing, FIGS. 2 and 3, particularly, show a sheet of opaque plastic, plastic film or the like, in the form of a substrate 10 defining protuberances 12 at its edges and/or corners, by which substrate 10 is caused to be overlaid by and connected to transparent layer 14, which also defines overlay protuberances 16 at its edges and/or corners.

Figure 1:
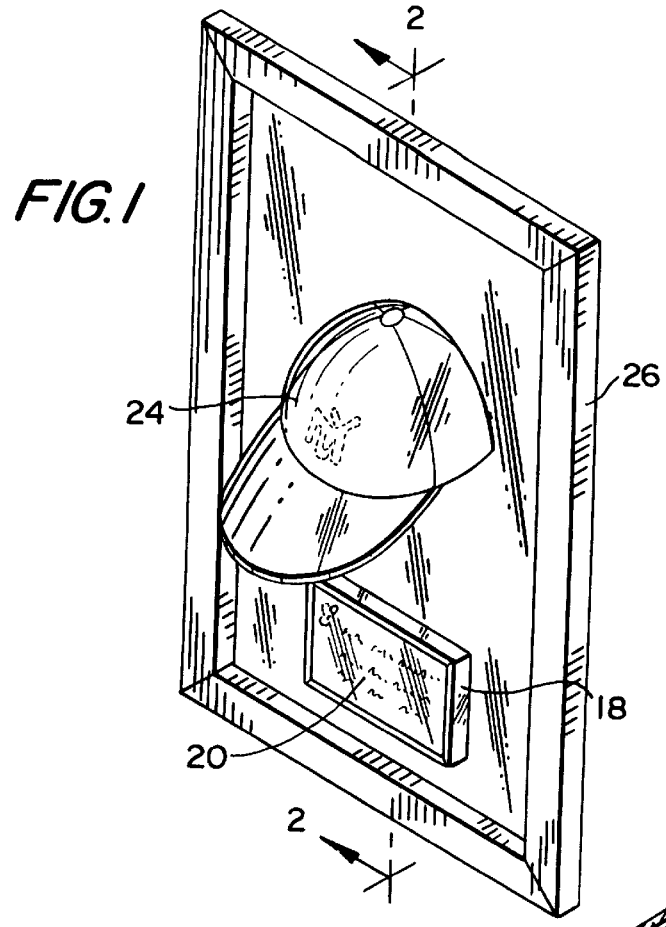
FIG. 1 is an isometric view showing the front, top and right side of a display structure for displaying and preserving an item of memorabelia, and for designating or explaining such item.

Transparent layer 14 defines a first forward expansion 22 for mounting and displaying a baseball cap 24 (FIG. 3) as shown in FIG. 1; and a second forward expansion 18 for mounting and displaying a plaque 20 (FIG. 3) as shown in FIG. 1.

Baseball cap 24 is shown folded, particularly in FIG. 2, whereby crown 24*a* is folded in half so that the rear half of crown is folded within the front half of the crown. For purposes of display and preservation and mounting by the structure described herein, bill 24*b* need not be folded, thereby to better display insignia 24*c* on crown 24*a*.

To complete the structure, for instance, a four piece frame 26 is used, with appropriate indentations 28 defined thereby in order to receive nested protuberances 16 and 12, as previously described, to hold the entire structure together.

In order to provide a complete understanding of the structure and use of the present invention, a series of assembly steps are now described. When a baseball cap, autographed by a professional player on the top of the bill or on the front of the crown, as obtained, and the recipient desires to describe the circumstances (game, date, etc.) upon which it was obtained for purposes of display, the structure of the present invention is useful. An adult baseball cap, for purposes of the size of the first protuberance 22 on transparent layer 14, means the use of a stock item, as to transparent layer 14. In other words, transparent layer 14 is probably inventoried in great quantity for that adult sizing. If the cap size is anything other than adult, either the stock adult size first forward expansion 22 is used, or a common heat machine is used on transparent sheet-like material in order to obtain the exact size for first forward expansion 22.

Sheet 10, the opaque substrate, is simply cut to size and heat-formed with protuberances 12, and with protuberances 16 formed by the same method in transparent layer 14. The substrate and the layer are snapped together with the cap, generally designated 24, therein; and with plaque 20 therein, indicating the name of the player, whose autograph appears on the cap, and the date of the game at which it was obtained.

The four piece frame 26 is assembled together in the usual manner, and fastened to the transparent layer 14 with substrate 10, by means of indentation 28. Alternatively, a one piece frame may be used, and designed to fasten to the transparent layer 14 with substrate 10, by means of indentation 28, in the same manner as with the four piece frame.

In this manner, a display structure is presented which attractively displays cap 24, as well as the explanatory plaque therebeneath, for hanging or leaning at the back of a shelf, or similarly displayed.

The foregoing describes a structure representing the present invention, but is not to be considered as a limitation thereof, since the only limitations on the scope of the present invention are by means of the following claims:

What is claimed is:

1. A display structure for memorabelia and a plaque designating said memorabelia, comprising an opaque substrate in a finite plane with edges, a transparent layer overlaying and coextensive with said substrate., and in a plane parallel to the plane of said substrate, said substrate and said transparent layer each defining means, at the edges thereof, for connecting said substrate and said transparent layer, a frame defining means for connection to said connected transparent layer and substrate, and said transparent layer defining a first forward expansion for mounting said memorabelia and a second forward expansion for mounting a designating plaque for said memorabelia.

2. The invention according to claim 1, wherein said memorabelia is a baseball cap and said means-at the edges comprise protuberances for nesting to connect said transparent layer and said substrate.

3. The invention according to claim 2, wherein said means for connection in said frame are indentations to receive said nested protuberances.

4. The invention according to claim 1, wherein said frame includes a plurality of pieces, each having said means for connection.

* * * * *